US006932634B2

(12) United States Patent
Cooper et al.

(10) Patent No.: US 6,932,634 B2
(45) **Date of Patent: *Aug. 23, 2005**

(54) HIGH FREQUENCY COAXIAL JACK

(75) Inventors: Steven R. Cooper, Round Lake Beach, IL (US); Zenon Sliczniak, Saint Charles, IL (US)

(73) Assignee: Switchcarft, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/843,534

(22) Filed: May 11, 2004

(65) Prior Publication Data

US 2004/0209521 A1 Oct. 21, 2004

Related U.S. Application Data

(63) Continuation of application No. 10/165,671, filed on Jun. 7, 2002, now Pat. No. 6,817,876.

(51) Int. Cl.[7] ..... H01R 29/00
(52) U.S. Cl. ..... 439/188
(58) Field of Search ..... 439/188, 76.1, 439/608, 108, 95, 507, 513

(56) References Cited

U.S. PATENT DOCUMENTS 5,280,254 A 1/1994 Hunter et al.
5,577,924 A 11/1996 Louwagie
5,702,262 A * 12/1997 Brown et al. ..... 439/188
5,885,096 A * 3/1999 Ogren ..... 439/188
5,893,767 A * 4/1999 Broschard, III ..... 439/188
5,904,579 A * 5/1999 McLean et al. ..... 439/63
5,964,607 A 10/1999 Finke et al.
6,045,378 A 4/2000 Follingstad
6,213,801 B1 4/2001 Tayloe et al.

* cited by examiner

*Primary Examiner*—J. F. Duverne
(74) *Attorney, Agent, or Firm*—Schiff Hardin LLP

(57) ABSTRACT

A switching coaxial jack has an electrically grounded housing that supports first and second connectors at a first end of the housing and third and fourth connectors at a second end of the housing. A first center conductor is disposed within the first connector, a second center conductor is disposed within the second connector, a third center conductor is disposed within the third connector, and a fourth center conductor is disposed within the fourth connector. A sliding switch within the housing has a first position that electrically couples the first and third center conductors to one another and a second position that electrically couples the first center conductor to one of the second center conductor and the terminating element.

14 Claims, 5 Drawing Sheets

HIGH FREQUENCY COAXIAL JACK

RELATED APPLICATIONS

This application is a continuation of U.S. application Ser. No. 10/165,671 filed Jun. 7, 2002 now U.S. Pat. No. 6,817,876.

TECHNICAL FIELD OF THE INVENTION

The present invention relates to coaxial jacks and, more particularly, to switching type coaxial jacks.

BACKGROUND OF THE INVENTION

Switching coaxial jacks are well known as shown in U.S. Pat. No. 6,045,378. Such coaxial jacks generally include two center conductors disposed within corresponding ports at a first end of a grounded electrically conductive housing, and two center conductors disposed within corresponding ports at an opposite second end of the grounded electrically conductive housing. Each center conductor at the first end of the housing is generally aligned with a corresponding one of the two center conductors at the second end of the housing. A switch is also provided in the housing.

When no plug is inserted into a port at the second end of the housing, the switch couples the two center conductors at the first end of the housing together. However, when a plug is inserted into a port at the second end of the housing, the switch couples the center conductor in that port to the aligned center conductor at the first end of the housing. Also, the switch terminates the other center conductor at the first end of the housing to ground through a terminating resistor.

Such video jacks have a number of problems. For example, the contacts of the switch typically used in prior art jacks are unreliable, particularly in dusty environments. Moreover, the switch contacts are not sufficiently isolated electrically and, thus, are subject to cross-talk. Moreover, many prior art jacks use switches having leaf springs that reduce the life expectancy of the jacks. Additionally, prior art jacks cannot be easily re-configured for different applications.

The jack of the present invention overcomes one or more of these or other problems.

SUMMARY OF THE INVENTION

In accordance with one aspect of the present invention, a switching coaxial jack comprises an electrically groundable housing, first, second, third, and fourth center conductors, a terminating element within the housing, and a sliding switch within the housing. The electrically groundable housing supports first and second connectors at a first end of the housing and third and fourth connectors at a second end of the housing. The first center conductor is disposed within the first connector, the second center conductor is disposed within the second connector, the third center conductor is disposed within the third connector, and the fourth center conductor is disposed within the fourth connector. The sliding switch has a first position that electrically couples the first and third center conductors to one another and a second position that electrically couples the first center conductor to one of the second center conductor and the terminating element.

In accordance with another aspect of the present invention, a switching coaxial jack comprises an electrically groundable housing supporting at least first, second, and third coaxial connectors, a sliding switch within the housing, and a non-contact spring. The first coaxial connector includes a first center conductor disposed therein, the second coaxial connector includes a second center conductor disposed therein, and the third coaxial connector includes a third center conductor disposed therein. The sliding switch is movable between first and second positions so as to control switching of the first, second, and third center conductors. The non-contact spring biases the sliding switch toward the first position.

In accordance with still another aspect of the present invention, a switching coaxial jack comprises an electrically groundable housing and a sliding switch within the housing. The electrically conductive housing supports at least first, second, and third coaxial connectors. The first coaxial connector includes a first center conductor disposed therein, the second coaxial connector includes a second center conductor disposed therein, and the third coaxial connector includes a third center conductor disposed therein. The sliding switch is movable between first and second positions so as to control switching of the first, second, and third center conductors.

In accordance with yet another aspect of the present invention, a switching coaxial jack comprises an electrically groundable housing, a terminating element within the housing, and a sliding switch. The electrically groundable housing supports at least first and second coaxial connectors. The first coaxial connector includes a first center conductor disposed therein, and the second coaxial connector includes a second center conductor disposed therein. The sliding switch is within the housing and has a first position that electrically couples the first and second center conductors to one another and a second position that electrically couples the first center conductor to the terminating element.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
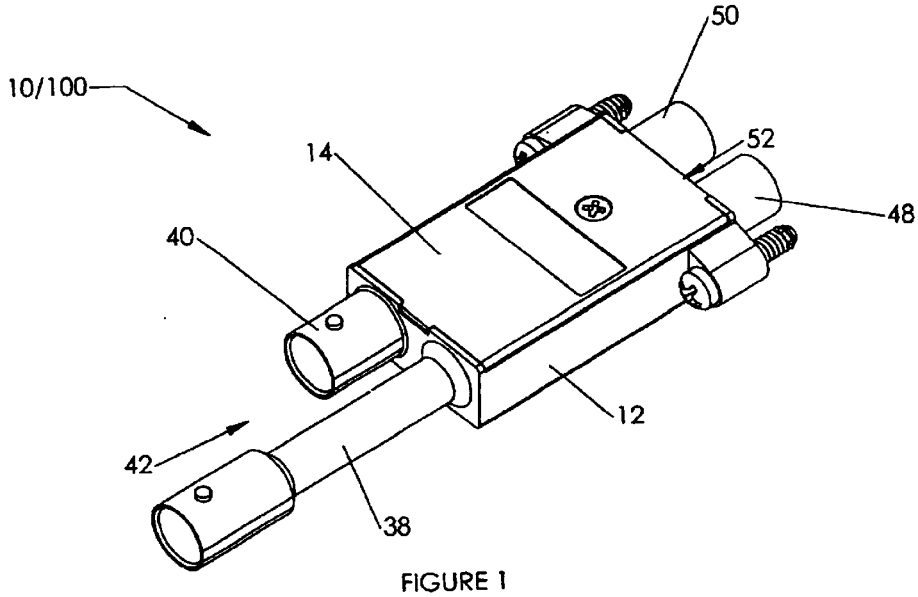
FIG. 1 is an isometric view of a video jack according to the present invention.

A dual self-terminating video jack 10 according to a first embodiment of the present invention is shown in FIGS. 1–7.

The dual self-terminating video jack 10 includes a housing 12 that can be closed with a cover 14. The housing and the cover are capable of being electrically grounded. A printed circuit board 16 is fastened to the housing 12 by screws 18 and 20. Sliders 22 and 24 (FIG. 5) are provided within the housing 12. Sliding contacts 26 and 28 are suitably affixed to the slider 22, and sliding contacts 30 and 32 are suitably affixed to the slider 24. Accordingly, the sliding contacts 26 and 28 move as the slider 22 moves, and the sliding contacts 30 and 32 move as the slider 24 moves. The sliding contacts 26, 28, 30, and 32 may be spring-type, bifurcated contacts.

Center conductors 34 and 36 are provided within corresponding connector ports 38 and 40 at a first end 42 of the dual self-terminating video jack 10, and center conductors 44 and 46 are provided within corresponding connector ports 48 and 50 at a second end 52 of the dual self-terminating video jack 10. The connector ports 38 and 40 with their corresponding center conductors 34 and 36 are arranged to receive coaxial connectors, such as BNC connectors, and the connector ports 48 and 50 with their corresponding center conductors 44 and 46 are arranged to receive coaxial connectors, such as WECO plugs.

Figure 3:
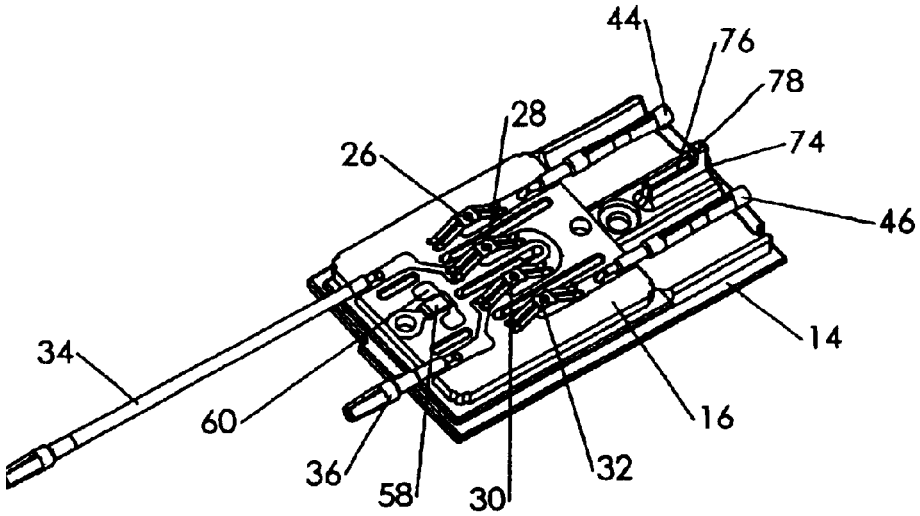
FIG. 3 is an isometric view of a first embodiment of the video jack illustrated in FIG. 1 and shows the inside of the cover and a printed circuit board with sliding contacts that form the switch of the video jack, where the switch is in a first switch position.

A spring 54 normally biases the slider 22 toward the second end 52 and away from the first end 42 of the dual self-terminating video jack 10. Similarly, a spring 56 normally biases the slider 24 toward the second end 52 and away from the first end 42 of the dual self-terminating video jack 10. Accordingly, as shown in FIG. 3, the sliding contacts 28 and 30, in combination with conducting traces on the printed circuit board 16, normally couple the center conductors 34 and 36 together. Also, the sliding contact 26 does not make a connection between the substantially aligned center conductors 34 and 44, and the sliding contact 32 does not make a connection between the substantially aligned center conductors 36 and 46.

A terminating resistor 58 is coupled between a metal trace 60 on the printed circuit board 16 and the housing 12 by way of the screw 20. A screw 62 fastens the cover 14 to the housing 12. The cover 14 has grounding fins 64, 66, 68, 70, and 72 (FIG. 6) that protrude through corresponding slots in the printed circuit board 16 (FIGS. 3 and 4) when the cover 14 is fastened to the housing 12. The grounding fins 64, 66, 68, 70, and 72 electrically isolate the conductor traces on the printed circuit board 16 from one another and the sliding contacts 26, 28, 30, and 32 from one another. The cover 14 of the dual self-terminating video jack 10 also has a grounding fin 74 that has a main fin portion 76 and an extended fin portion 78. The extended fin portion 78 locates and holds a grounding clip 80 (FIGS. 2, 5, and 7), and the main fin portion 76 provides a shield between chambers that are formed between the housing 12 and the cover 14 at the second end 52 of the dual self-terminating video jack 10.

Figure 2:
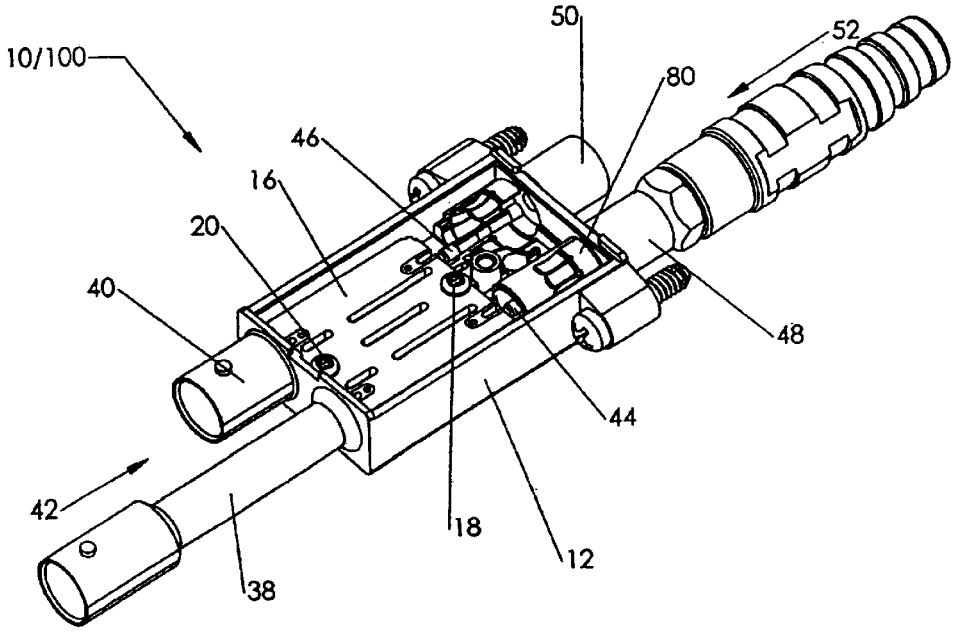
FIG. 2 shows the video jack of FIG. 1 with the cover removed.
Figure 4:
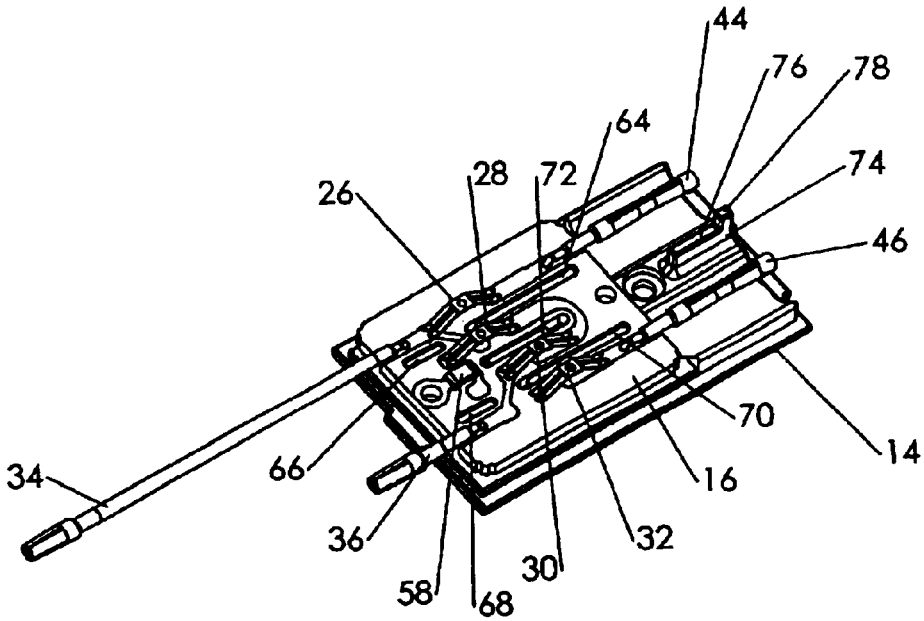
FIG. 4 is the same isometric view as FIG. 3 but where the switch is in a second switch position.
Figure 5:
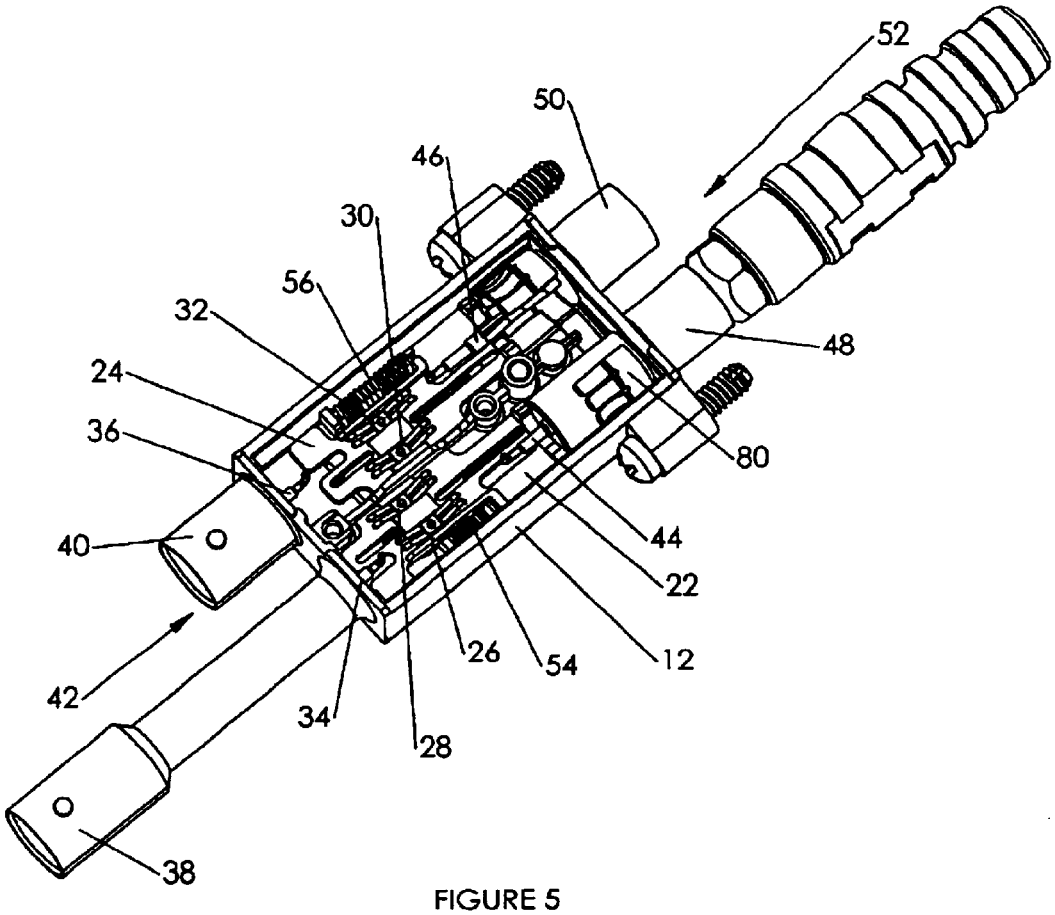
FIG. 5 is an isometric view of the jack of FIG. 1 with the cover and the printed circuit board removed.
Figure 6:
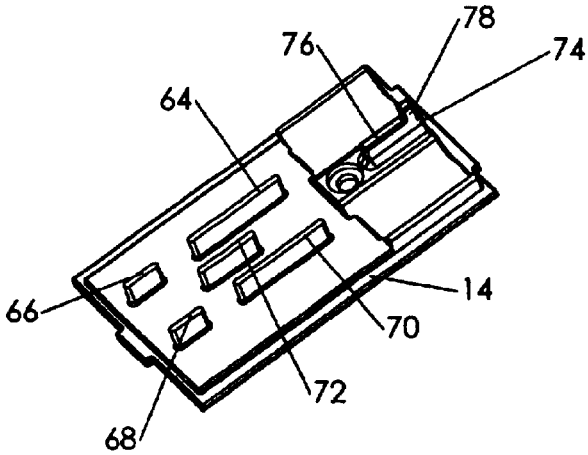
FIG. 6 is an isometric view of the inside of the cover of the video jack of FIGS. 1–5.
Figure 7:
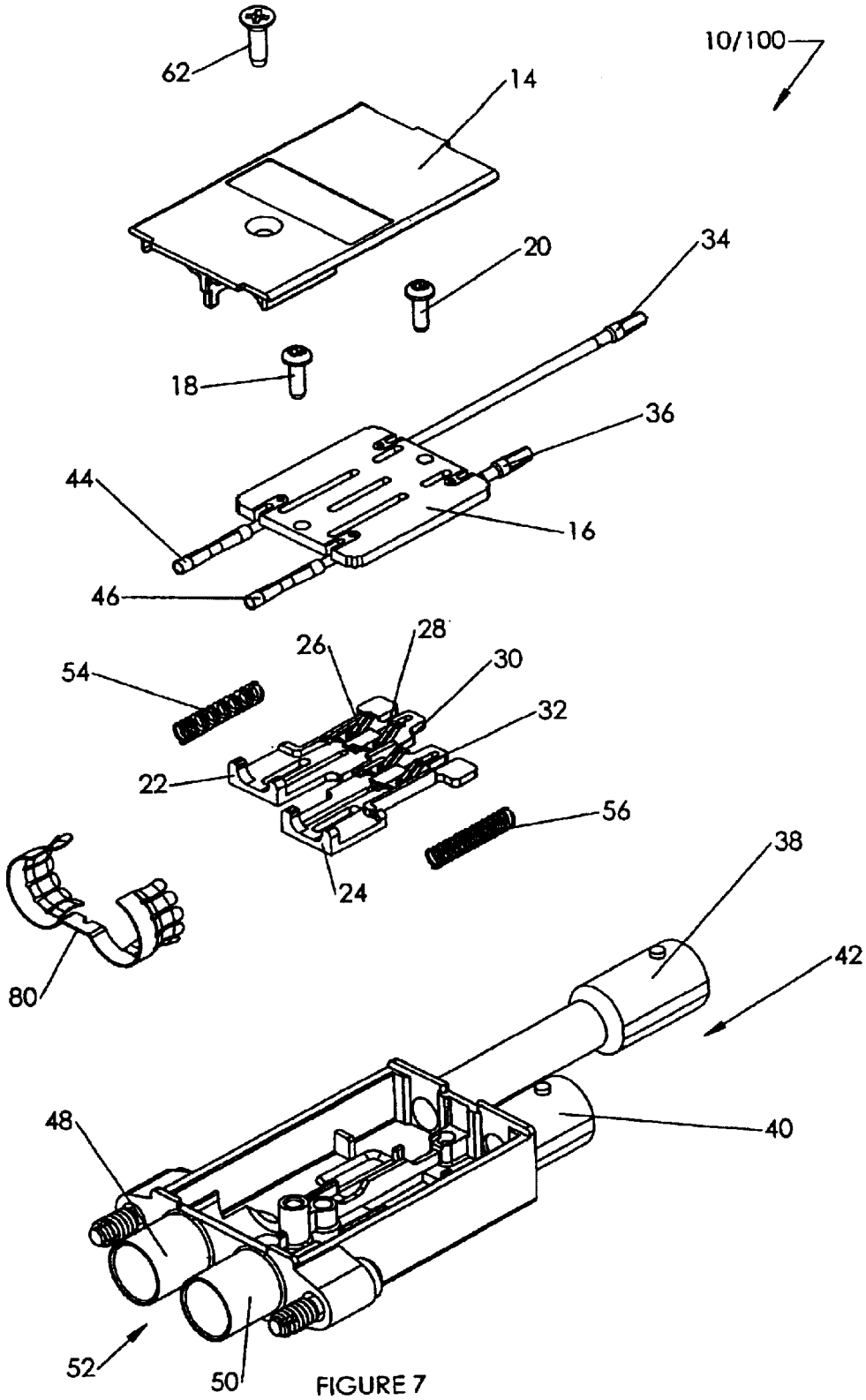
FIG. 7 is an exploded view of the video jack of FIGS. 1–6.
Figure 8:
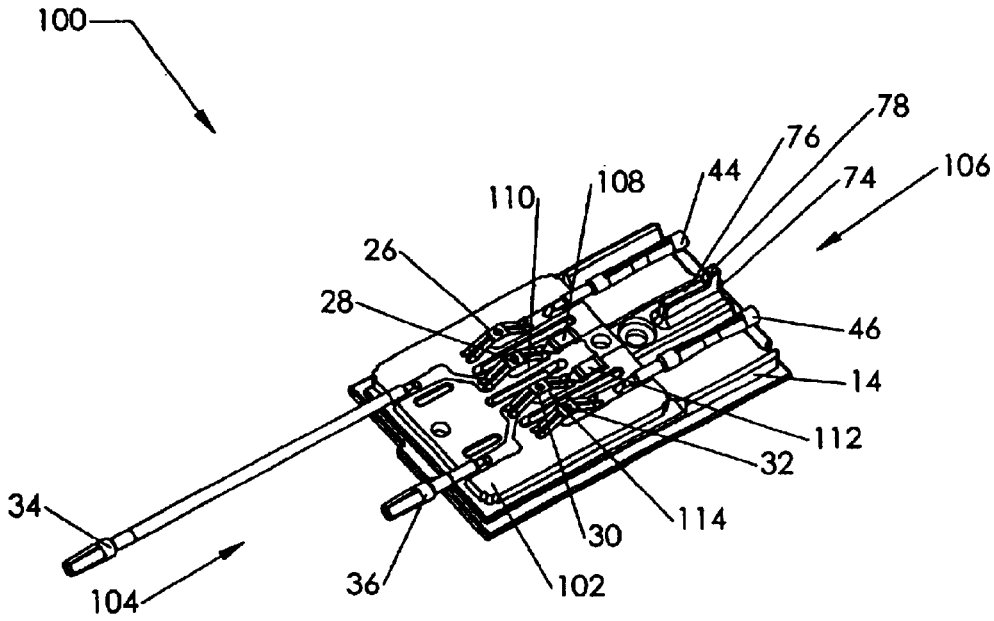
FIG. 8 is an isometric view of a second embodiment of the video jack illustrated in FIG. 1 and shows the inside of the cover and a printed circuit board with sliding contacts that form the switch of the video jack, where the switch is in a first switch position; and, FIG. 9 is the same isometric view as FIG. 8 but where the switch is in a second switch position.

When a plug is inserted into the connector port 48 as shown in FIGS. 2 and 5, the slider 22 moves against the spring 54 toward the first end 42. As shown in FIG. 4, movement of the slider 22 causes the sliding contact 26, in combination with conducting traces on the printed circuit board 16, to establish a connection between the center connectors 34 and 44. Movement of the slider 22 also causes the sliding contact 28 to disconnect the center conductor 34 from the center conductor 36 and instead to connect the center conductor 36 to the housing 12 through the sliding contact 30 and the terminating resistor 58. The slider 24 is unmoved.

On the other hand, although not shown in the drawings, when a plug is inserted into the connector port 50, the slider 24 moves against the spring 56 toward the first end 42. Movement of the slider 24 causes the sliding contact 32, in combination with conducting traces on the printed circuit board 16, to establish a connection between the center connectors 36 and 46. Movement of the slider 24 also causes the sliding contact 30 to disconnect the center conductor 34 from the center conductor 36 and instead to connect the center conductor 34 to the housing 12 through the sliding contact 28 and the terminating resistor 58. The slider 22 is unmoved.

A dual straight-through video jack 100 according to a second embodiment of the present invention is illustrated in FIGS. 1, 2, 5, 6, 7, 8 and 9. Thus, the only difference between the dual self-terminating video jack 10 and the dual straight-through video jack 100 is the printed circuit board. Accordingly, the same reference numerals are used when the same elements are depicted in the dual self-terminating video jack 10 and in the dual straight-through video jack 100.

The dual straight-through video jack 100 may include the housing 12 that can be closed with the cover 14. A printed circuit board 102 is fastened to the housing 12 by the screws 18 and 20. The sliders 22 and 24 are likewise provided within the housing 12 of the dual straight-through video jack 100. The sliding contacts 26 and 28 are suitably affixed to the slider 22, and the sliding contacts 30 and 32 are suitably affixed to the slider 24. Accordingly, the sliding contacts 26 and 28 may be moved relative to the printed circuit board 102, and the sliding contacts 30 and 32 may be separately moved relative to the printed circuit board 102.

The center conductors 34 and 36 are provided through corresponding connector ports at a first end 104 of the dual straight-through video jack 100, and the center conductors 44 and 46 are provided through corresponding connector ports at a second end 106 of the dual straight-through video jack 100.

A first terminating resistor 108 is coupled between a first conducting trace 110 on the printed circuit board 102 and the housing 12 through the screw 18. A second terminating resistor 112 is coupled between a second conducting trace 114 on the printed circuit board 102 and the housing 12 through the screw 18.

The spring 54 normally biases the slider 22 affixed to the sliding contacts 26 and 28 toward the second end 106 and away from the first end 104 of the dual straight-through video jack 100. Similarly, the spring 56 normally biases the slider 24 affixed to the sliding contacts 30 and 32 toward the second end 106 and away from the first end 104 of the dual straight-through video jack 100. Accordingly, the sliding contact 28 normally couples the center conductor 34 to ground through the first terminating resistor 108. Also, the sliding contact 30 normally couples the center conductor 36 to ground through the second terminating resistor 112. The center conductors 44 and 46 are in a normally open circuit condition.

Figure 9:
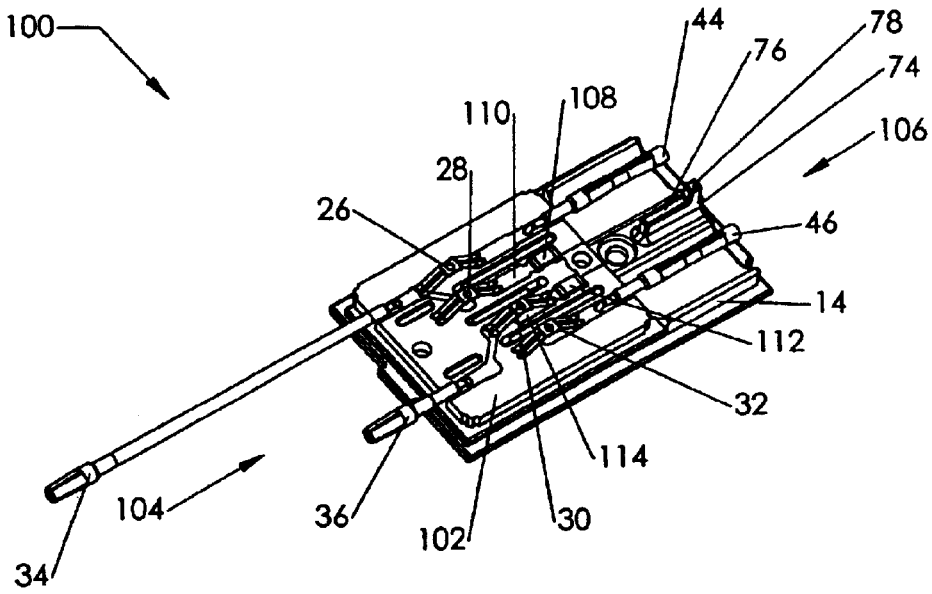

When a plug is inserted into the connector port 48 surrounding the center conductor 44, the slider 22 moves the sliding contacts 26 and 28 to the positions shown in FIG. 9. Accordingly, the center conductors 34 and 44 are coupled together by the sliding contact 26 in combination with conducting traces on the printed circuit board 102. Movement of the slider 22 also causes the sliding contact 28 to disconnect the center conductor 34 from the first terminating resistor 108. However, because the sliding contacts 30 and 32 did not move, the center conductor 36 is still coupled to ground through the second terminating resistor 112, and the center conductor 46 is still in an open circuit condition.

Similarly, when a plug is inserted into the connector port 50 surrounding the center conductor 46, the slider 24 moves the sliding contacts 30 and 32 so that the center conductors 36 and 46 are coupled together by the sliding contact 32 in combination with conducting traces on the printed circuit board 102. Movement of the slider 24 also causes the sliding contact 30 to disconnect the center conductor 36 from the second terminating resistor 112. However, because the sliding contacts 26 and 28 did not move, the center conductor 34 is still coupled to ground through the first terminating resistor 108, and the center conductor 44 is still in an open circuit condition.

Exemplary materials may be used as described in this paragraph. However, it should be understood that other materials could be used without departing from the scope of the present invention. Accordingly, the housing and cover may comprise a zinc alloy plated with nickel. The grounding clip may be beryllium copper finished with gold or nickel plating. The springs may be stainless steel springs, and/or may be compression springs or extension springs. The sliders may be polyetherimide. The sliding contacts may be beryllium copper finished with gold plating and further may be bifurcated as shown. The printed circuit boards may be PCB-Hydrocarbon having conducting traces made of copper finished with gold over nickel plating. The center connectors may be beryllium copper finished with gold plating. Each of the screws may be a steel alloy plated with zinc.

The sliding contacts 26, 28, 30, and 32 are more reliable that the contacts typically used in prior art jacks, and the sliding contacts 26, 28, 30, and 32 perform better in dusty environments. Moreover, the grounding fins 64, 66, 68, 70, and 72 described above sufficiently isolate the sliding contacts and the conducting traces on the printed circuit board that cross-talk is materially reduced. Also, the springs 54 and 56 extend the life expectancy of video jacks over video jacks using leaf spring contacts. Furthermore, the use of a printed circuit board in the jacks allows the jacks to be easily re-configured for different applications. For example, a printed circuit board may configure a jack as a normalled jack with one or more terminating resistors, as a normalled jack without terminating resistors, as a non-normalled jack with one or more terminating resistors, or as a non-normalled jack without terminating resistors. The dual self-terminating video jack 10 is an example of a normalled jack, and the dual straight-through video jack 100 is an example of a non-normalled jack.

Certain modifications of the present invention have been disclosed above. Other modifications will occur to those practicing in the art of the present invention. For example, the video jacks described above may come in a variety of sizes.

Moreover, the video jacks described above may be used as audio and/or other jacks.

Furthermore, the terminating resistor 58 is used as the terminating element in the dual self-terminating video jack 10, and the terminating resistors 108 and 112 are used as the terminating elements in the dual straight-through video jack 100. Instead, other passive and/or active devices may be used as the terminating elements in the dual self-terminating video jack 10 and/or in the dual straight-through video jack 100.

Also, the jacks of the present invention may have any number of ports. For example, a jack in accordance with an embodiment of the present invention may have just two ports located at opposite ends of the housing and a sliding switch that has a first position in which the two ports are coupled together and a second position in which one of the two ports is coupled to a terminating element and the second port is open. As another example, a jack in accordance with another embodiment may have just three ports with two of the three ports located at of the end of the housing and the remaining port located at the opposite end of the housing. A sliding switch controls coupling of the first, second, and third ports.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A switching coaxial jack comprising:

an electrically groundable housing supporting at least first, second, and third coaxial connectors, wherein the first coaxial connector includes a first center conductor disposed therein, wherein the second coaxial connector includes a second center conductor disposed therein, and wherein the third coaxial connector includes a third center conductor disposed therein;

a sliding switch within the housing movable between first and second positions so as to control switching of the first, second, and third center conductors, wherein the sliding switch comprises spring-type sliding contacts; and, a non-contact spring biasing the sliding switch toward the first position.

2. The switching coaxial jack of claim 1 wherein the housing comprises fins that extend through corresponding opening in the printed circuit board so as to electrically is isolate the first and second coaxial connectors from one another.

3. The switching coaxial jack of claim 1 wherein the spring-type sliding contacts comprise bifurcated spring-type sliding contacts.

4. The switching coaxial jack of claim 1 wherein the sliding switch, in the first position, electrically couples the first and third center conductors to one another and, in the second position, electrically couples the first center conductor to a terminating element.

5. The switching coaxial jack of claim 1 wherein the sliding switch, in the first position, electrically couples the first and third center conductors to one another and, in the second position, electrically couples the first center conductor to the second center conductor.

6. A switching coaxial jack comprising:

an electrically groundable housing supporting at least first, second, and third coaxial connectors, wherein the first coaxial connector includes a first center conductor disposed therein, wherein the second coaxial connector includes a second center conductor disposed therein, and wherein the third coaxial connector includes a third center conductor disposed therein; and, a sliding switch within the housing movable between first and second positions so as to control switching of the first, second, and third center conductors, wherein the sliding switch comprises at least first, second, and third sliding contacts, each of the first, second, and third sliding contacts being continuously conductive between first and opposing ends.

7. The switching coaxial jack of claim 6 wherein the housing comprises fins that provide electrical isolation for at least the first and second first and second coaxial connectors from one another.

8. The switching coaxial jack of claim 6 wherein the first, second, and third sliding contacts comprise corresponding spring-type bifurcated sliding contacts.

9. The switching coaxial jack of claim 6 wherein the sliding switch, in the first position, electrically couples the first and third center conductors to one another and, in the second position, electrically couples the first center conduct to a terminating element.

10. The switching coaxial jack of claim 6 wherein the sliding switch, in the first position, electrically couples the first and third center conductors to one another and, in the second position, electrically couples the first center conductor to the second center conductor.

11. The switching coaxial jack of claim 6 wherein the sliding switch further comprises a fourth sliding contact.

12. A switching coaxial jack comprising:

an electrically groundable housing supporting first and second connectors at a first end of the housing and third and fourth connectors at a second end of the housing;

a first center conductor disposed within the first connector;

a second center conductor disposed within the second connector;

a third center conductor disposed within the third connector;

a fourth center conductor disposed within the fourth connector;

a switch within the housing having at least first and second contacts, wherein the first contact is movable to electrically couple the first and third center conductors to one another, and wherein the second contact is movable to electrically couple the second and fourth center conductors to one another; and, fins protruding from the housing so as reduce cross-talk between the first and second connectors.

13. The switching coaxial jack of claim 12 wherein the switch comprises a printed circuit board having conducting traces cooperating with the first and second contacts, and wherein the fins extend through the printed circuit board.

14. The switching coaxial jack of claim 12 wherein the switch comprises third and fourth contacts, wherein the first, second, third, and fourth contacts have a first position in which the first and second center conductors are connected together and the third and fourth center conductors are in an open circuit condition, wherein the first second, third, and fourth contacts have a second position in which the first and third center conductors are connected together and the second center conductor is terminated through a terminating element.

* * * * *

UNITED STATES PATENT AND TRADEMARK OFFICE

CERTIFICATE OF CORRECTION

PATENT NO. : 6,932,634 B2
DATED : August 23, 2005
INVENTOR(S) : Steven R. Cooper and Zenon Silczniak It is certified that error appears in the above-identified patent and that said Letters Patent is hereby corrected as shown below:

Title page,
Item [73], Assignee, "Switchcarft, Inc." to -- Switchcraft, Inc. --

Signed and Sealed this

First Day of November, 2005

JON W. DUDAS
*Director of the United States Patent and Trademark Office*